US006481015B1

(12) United States Patent
Lanier

(10) Patent No.: US 6,481,015 B1
(45) Date of Patent: Nov. 19, 2002

(54) TEXTILE COMPLEX FOR MAKING CLOTHES FOR PROTECTION AGAINST HEAT

(75) Inventor: Thierry Lanier, Vienne (FR)

(73) Assignee: Europrotect France SA (FR)

( * ) Notice: Subject to any disclaimer, the term of this patent is extended or adjusted under 35 U.S.C. 154(b) by 0 days.

(21) Appl. No.: 09/744,380

(22) PCT Filed: Jul. 23, 1999

(86) PCT No.: PCT/FR99/01822

§ 371 (c)(1),
(2), (4) Date: Jun. 4, 2001

(87) PCT Pub. No.: WO00/04798

PCT Pub. Date: Feb. 3, 2000

(30) Foreign Application Priority Data

Jul. 23, 1998 (FR) ..... 98 09582

(51) Int. Cl.[7] ..... F41H 1/02; F41H 1/04

(52) U.S. Cl. ..... 2/2.5; 2/81; 2/69; 2/243 R; 428/166; 428/920

(58) Field of Search ..... 2/81, 69, 82, 87, 2/93, 2.5, 97, 243 R; 428/166, 178, 920, 921

(56) References Cited

U.S. PATENT DOCUMENTS

| | | | |
|---|---|---|---|
| 4,451,934 | A | 6/1984 | Gioello |
| 5,098,770 | A | 3/1992 | Paire |
| 5,150,476 | A | 9/1992 | Stratham et al. |
| 5,274,849 | A | 1/1994 | Grilliot et al. |
| 5,572,991 | A | 11/1996 | Grilliot et al. |

FOREIGN PATENT DOCUMENTS

| | | | |
|---|---|---|---|
| DE | 297 21 011 | U1 | 4/1998 |

*Primary Examiner*—John J. Calvert
*Assistant Examiner*—Robert Muromoto, Jr.
(74) *Attorney, Agent, or Firm*—Cantor Colburn LLP

(57) ABSTRACT

A textile complex is provided including at least a fabric, a textile lap, made of inflammable material, designed to form the external surface of the complex, and a comfort and hygiene lining designed to form the complex internal surface. On the fabric internal surface and/or the lining external surface folds are provided having substantially the same orientation with respect to each other, fixed on the fabric and/or the lining, and defining between the fabric and the lining air-filled passages.

17 Claims, 3 Drawing Sheets

$T_{12}$ (s)
75
65
55
45
35
25
15
5
0
5
10
15
20
25
30
35
40
45
$Q_o$ (kW/m$^2$)
A
B
C
D
E
F
F

TEXTILE COMPLEX FOR MAKING CLOTHES FOR PROTECTION AGAINST HEAT

FIELD OF THE INVENTION

The subject of the present invention is a textile complex for the production of thermal protective garments. The complex involved here is intended to provide thermal protection against heat and flames, being used for the production of garments for firemen, but also, more generally, in other fields of activity where there is a risk of burns due to heat or flames.

DESCRIPTION OF THE RELATED ART

As they did quite some time ago, firemen in France wear a leather jacket fitted with a cotton or woolen inner lining for comfort. Such a jacket does not provide suitable internal thermal protection. In other countries, the jackets worn by firemen are based on a textile, either without a waterproof barrier, which results in a reduction in the thermal protection, or with a waterproof barrier impermeable to water vapor, which prevents the evaporation of transpiration and increases the problem of thermal stress. Thermal stress is a physiological phenomenon resulting from the rise in internal body temperature, occurring due to the effect of external factors such as a hot environment or due to the effect of great and prolonged effort. Thermal stress is manifested by a rise in the internal temperature of the body which can no longer thermally regulate itself, which in turn can lead to illnesses, or even fainting or a cardiac event. It is now known that when the body temperature exceeds the normal temperature by +1.5° C., the judgement and reaction faculties are impaired to the point of leading to accidents in dangerous environments. The latest study on the deaths of firemen in the USA gives only 8% of deaths by burning, 42% of deaths are due directly to thermal stress while the remaining 50% are accidents without any obvious cause but which specialists increasingly compare with stupid accidents due to judgement being impaired by thermal stress.

There is a European directive relating to personal protective equipment used especially by firemen. A jacket must meet a certain number of criteria, especially those relating to protection against radiant heat and protection against convective heat, must have good thermal stability in terms of the constituent materials, must fulfil pure non-flammability criteria and must have a high impermeability.

Furthermore, a jacket must allow an operator to be protected under extreme conditions of the accident type, especially by allowing him time to escape. Thus, it is in particular necessary to protect a fireman from the phenomenon of flashover. Flashover is a very rapid transition step in the development of an urban fire and occurs when gases and vapors present in a room reach a temperature of 500 to 600° C. and suddenly burst into flames. In a fraction of a second, the temperature rises from 500 to 1000° C., corresponding to an incident heat flux of about 40 kW/m$^2$. It is necessary for an operator to be able to withstand this sudden temperature increase for long enough to allow him to move away from the heat source.

It is known how to produce a textile complex allowing these objectives to be achieved. Such a textile complex comprises an outer protective fabric made of a non-flammable material, for example based on aramid meta-aramid or polyamideimide fiber. This fabric incorporates thermal protection properties, provides mechanical strength in terms of abrasion and tear resistance, and has undergone a water-repellency treatment in order to make water and chemical liquids in general to run off it as beads. Behind this protective fabric is an impermeable but breathable membrane, generally attached to a textile surface giving it mechanical strength, letting through the water vapor resulting, for example, from the transpiration of the wearer, but not water in its liquid form. Furthermore, this membrane provides a windbreak effect, which contributes to the thermal insulation of the jacket by reducing the rate of penetration of the heat flux. Placed under the membrane is thermal insulation consisting of a three-dimensional knit, like that described in document EP 0 443 991, or of a felt capable of trapping air, as described in document EP 0 364 370. This thermal insulation is generally sewn onto an antisoil lining.

Such a jacket has the advantage of providing excellent thermal protection against an extremely high heat flux of 40 kW/m$^2$, with efficiency which is very high, or indeed excessively high since, because of its high insulatability, it does not allow the user to be aware of heat with a heat flux of 0 to 1 kW/m$^2$, corresponding to the normal working conditions for firemen, or to detect potential danger. The over-protected operator, under these conditions, may be led to take ill-considered risks owing to impairment of his perception of the heat flux. Such a jacket is also not very comfortable as it is thick and heavy, and it becomes laden with water, especially in the thermal insulation material, which can, in the event of a sudden temperature rise, result in this water vaporizing and possibly burning the operator.

Furthermore, when the jacket is wetted, after work in a wet environment, or after it is washed, the felt or knit absorbs a great deal of water, which requires a lengthy drying operation during which the jacket cannot be used.

FIGS. 1 and 2 show two graphs illustrating the behavior of various complexes intended for producing garments for firemen, taking account of the European Standard EN 469.

FIG. 1 illustrates the change in the heat transmission factor TF% which is the ratio of the heat flux that has passed through the product to the incident heat flux $Q_0$. The incident heat flux is the heat flux generated by a heat source to which the sample is exposed.

FIG. 2 illustrates the change in the alerting time $T._{12}$ as a function of the incident heat flux $Q_0$. The alerting time is the time after which the wearer becomes painfully aware of the heat. It is sought to obtain a $T._{12}$ of about 15 seconds for an incident flux of 40 kW/m$^2$.

The various curves shown in FIGS. 1 and 2 were obtained by taking measurements on the following products or complexes, using the method in the standard EN 366 as described in its draft revision CEN/TC162/WG2/N266 of27/01/97:

A=leather

B=leather+cotton lining

C=leather+wool lining

D=woven+membrane+90 g/m$^2$ nonwoven+120 g/m$^2$ lining

E=woven+membrane+220 g/m$^2$ knit+120 g/m$^2$ lining

F=woven+membrane+120 g/m$^2$ felt+120 g/m$^2$ lining.

As examples, the following products were used:

Woven: a woven of reference 4781 from DMC Tissus Techniques, 2/1 twill, 195 g/m$^2$, made of Nomex® Delta TA from Dupont de Nemours, a mixture of 75% meta-aramid fibers, 23% para-aramid fibers and 2% anti-static fibers.

Membrane: Reference 89/55 from Proline, an impermeable but breathable microporous membrane made of fire-retardant polyurethane, about 40 g/m$^2$, laminated to a Sontara® Nomex® SL type E-89 nonwoven, a mixture of meta-aramid and para-aramid, about 90 g/m$^2$.

Lining: a woven of reference 4948 from DMC Tissus Techniques, cloth, 120 g/m$^2$, made of Nomex®/Viscose FR, a mixture of 50% meta-aramid fibers and 50% bulk-fire-retardant viscose fibers.

Non-woven: Sontara® Nomex® SL Type E-89, a mixture of meta-aramid and para-aramid, about 90 g/m$^2$.

Knit: a three-dimensional knit of reference AR220 from TTI, 220 g/m$^2$, made of Nomex® T450, 100% meta-aramid.

Felt: a needle-punched felt from DUFLOT, 120 g/m$^2$, made of Nomex®, 100% aramid.

These various curves summarize perfectly the advantages and disadvantages of the various known jackets given above.

SUMMARY OF THE INVENTION

The object of the invention is to provide a textile complex for producing garments, which is lightweight and comfortable, which, under the usual operating conditions (flux from 0 to about 1 kW/m$^2$), transmits heat relatively well (corresponding to a high TF%) and rapidly alerts the operator to the presence of danger (corresponding to a low $T_{.12}$) and which, under critical conditions, such as a heat flux resulting from a flashover phenomenon (a flux of about 40 kW/m$^2$), provides, over a sufficient period of time and in accordance with the standards, a high degree of insulation (i.e. a low TF%) so as to ensure that the operator has a reasonable time in which to escape. Furthermore, this complex, when wet, must be able to be rapidly dried.

For this purpose, the textile complex of the invention, of the type comprising at least one textile web or fabric, made of a non-flammable material, intended to form the outer face of the complex, and a comfort and antisoil lining intended to form the inner face of the complex, is characterized in that on the inner face of the fabric and/or on the outer face of the lining there are ribs of textile material having approximately the same orientation and fastened by bonding to the fabric and/or to the lining during its manufacture, in order to form an integral part thereof, and defining air-filled channels between the fabric and the lining.

The ribs define, with the lining on the one hand, and that wall of the complex which faces the liner on the other, channels which are filled with air. This air is not static but can circulate, insofar as it is not trapped by a tight knit as is the case, for example, with structures of the three-dimensional knit or mesh type. Thus, under normal operating conditions (a heat flux of 0 to 1 kW/m$^2$), there is no water retention in these channels nor is the air greatly overheated. On the other hand, when there is a very sudden temperature rise (for example a heat flux of about 40 kW/m$^2$), the amount of air within the channels defined by the ribs constitutes thermal insulation which is sufficient, and which satisfies the EN 469 standard, to allow the operator to move away from the dangerous location.

This simplicity of structure contributes to the lightness of the garment obtained, and consequently to its comfort. The latter is enhanced by the circulation of air in the channels, which promotes the evaporation of sweat absorbed by the lining. Indeed it is known that, in order to assist the thermoregulation of the body, it is absolutely paramount to allow the sweat to evaporate. When the body temperature rises, the transpiration mechanism comes into play in order to cool the body by evaporation of the sweat. If the sweat cannot evaporate and so builds up in the form of liquid in the various textile layers, the thermoregulating mechanism of sweating is neutralized and the body temperature continues to rise. These characteristics, on the one hand, improve the thermoregulation of the operator's body and reduce the thermal stress and, on the other hand, make it easier for the garment to be dried when it has become wet, during firefighting, or so as to clean it, since, because of its very reduced structure, the ability of the invention to absorb and store water amounts to practically that of the lining supporting the ribs, compared with that of a felt which acts like a sponge. The main drawback of the current complexes, such as three-dimensional knits or felts, is precisely their low propensity to allow evaporation of the transpiration. They have, on the contrary, a tendency to absorb moisture and to store it.

Advantageously, the ribs are made of a material which compresses little with an increase in heat.

This makes it possible to maintain a volume of insulating air sufficient to provide protection, including under the effect of a high heat flux (for example about 40 kW/m$^2$).

According to a first embodiment of this complex, each rib is made from heat-stable fibers, such as para-aramid fibers.

Advantageously, in this case each rib is formed by a combination of yarns assembled together, for example two Nm 8/2 folded yarns twisted together. Such a structure is less compressible than a yarn of equivalent titer composed of a single ply.

According to one possibility, again in the case of this type of rib, each rib is fastened to the lining by bonding using the threads of this lining during the manufacture of the latter.

In order to provide a sufficient volume of air between the ribs, the thickness of each rib is greater than 0.3 mm and preferably between 1 and 10 mm, and the spacing of the ribs is greater than 2 mm and preferably between 2 and 15 mm.

In order to encourage the air to circulate, in the case of a garment produced from such a textile complex, like that which has just been defined, the ribs and the channels that they define have a longitudinal overall orientation with respect to the garment, and especially a vertical orientation in the case of a jacket, encouraging the air to circulate by the natural phenomenon of convection.

It is possible to provide, between the outer protective fabric and the lining, an impermeable but breathable membrane letting water vapor through but not water in liquid form, this membrane also having a windbreak effect favorable to thermal protection.

BRIEF DESCRIPTION OF THE DRAWINGS

In any case the invention will be fully understood with the aid of the description which follows, with reference to the appended schematic drawings showing, by way of non-limiting examples, an embodiment of this textile complex and an embodiment of a jacket obtained using this complex.

DETAILED DESCRIPTION OF PREFERRED EMBODIMENT

Figure 1:
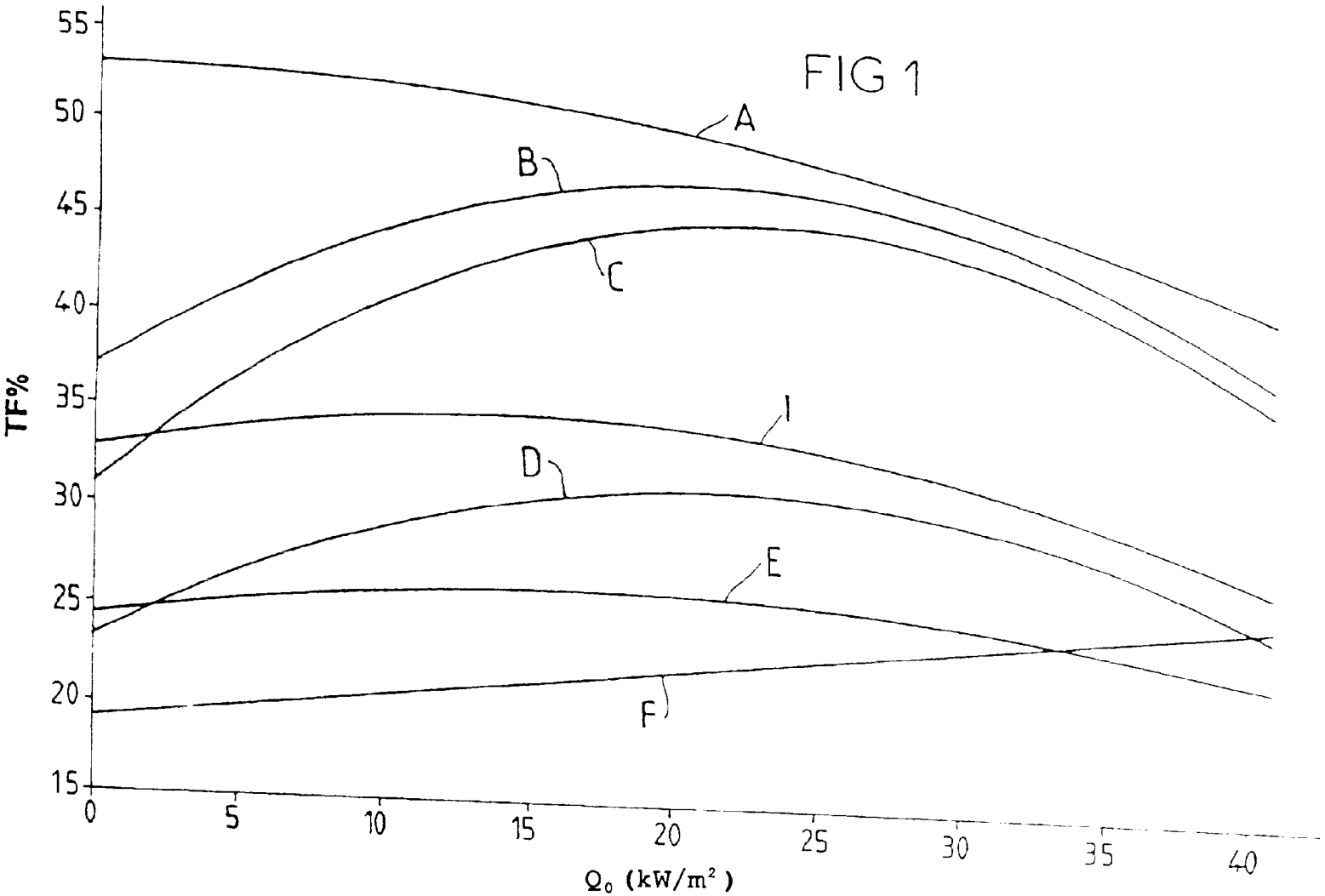
FIG. 1 shows a series of curves illustrating the change in heat transmission factor TF% as a function of the incident heat flux $Q_0$.

The complex shown in the drawing comprises an outer protective fabric 2 made of a non-flammable material, consisting of a woven of reference 4781 from DMC Tissus Techniques, 2/1 twill, 195 g/m$^2$, made of Nomex® Delta TA from Dupont de Nemours, a mixture of 75% meta-aramid fibers, 23% para-aramid fibers and 2% anti-static fibers. Placed against this outer fabric is an impermeable but breathable membrane consisting of the reference 89/55 from Proline, an impermeable but breathable microporous membrane made of fire-retardant polyurethane, approximately 40 g/m$^2$, laminated to a Sontara® Nomex® SL Type E-89 nonwoven, a mixture of meta-aramid and para-aramid, about 90 g/m$^2$.

Finally, the complex includes a lining 4 consisting, for example, of a woven of reference 4948 from DMC Tissus Techniques, 120 g/m$^2$ cloth, made of Nomex™/Viscose FR, a mixture of 50% meta-aramid fibers and 50% bulk-fire-retardant viscose fibers.

Fastened to the lining 4, on the side facing the membrane 3, is a series of parallel continuous ribs 5 having a surface density of 70/80 g/m$^2$, consisting in the present case of an Nm 8/2/2 strand of 100% para-aramid fibers (a two-ply Nm 8/2 folded yarn). If the lining consists of a woven, the ribs are bonded to the woven during weaving, by a particular change in some of the ground yarns of said woven.

Figure 3:
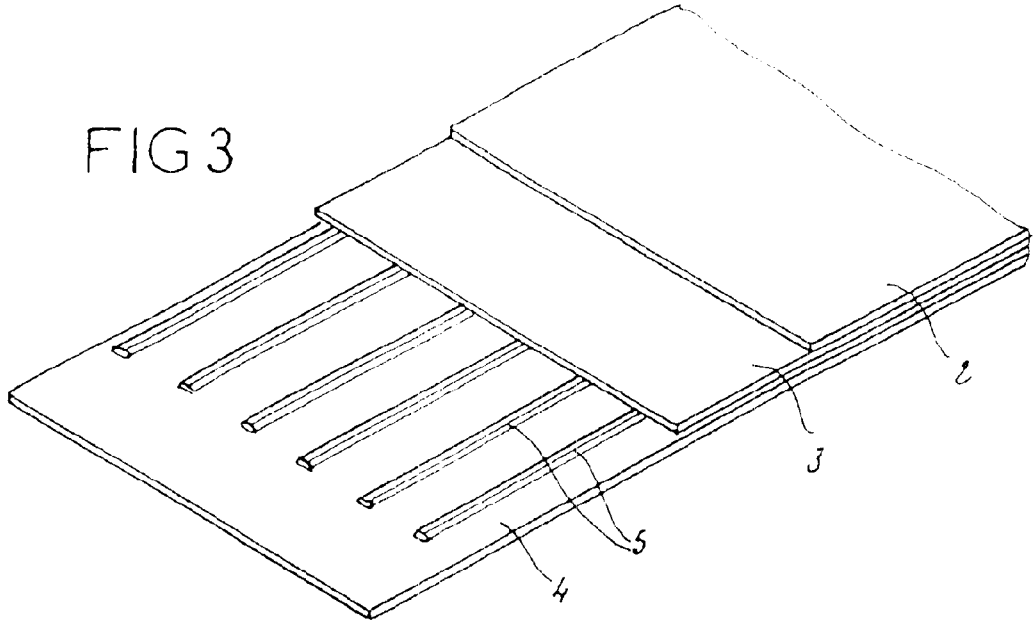
FIG. 3 is an exploded perspective view of the various constituent layers of the complex.
Figure 4:
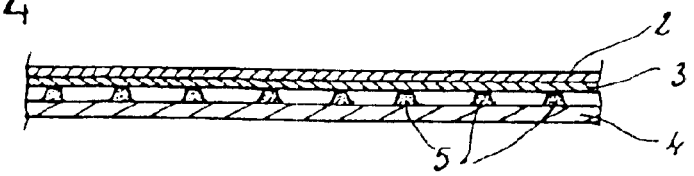
FIG. 4 is a sectional view of this complex transverse to the ribs that the latter has.
Figure 5:
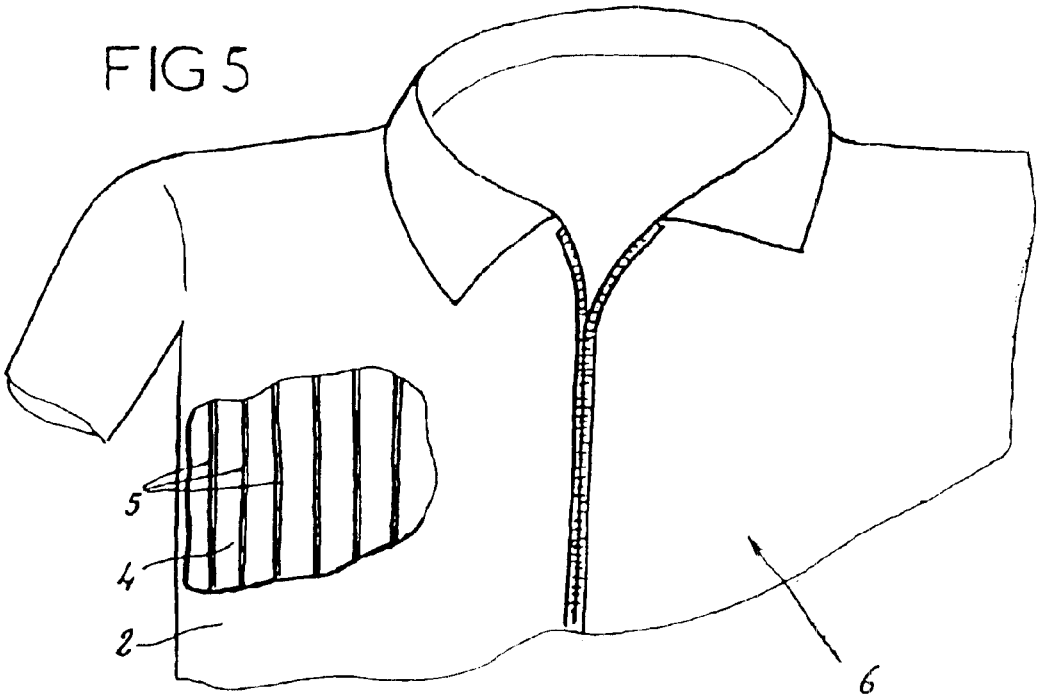
FIG. 5 is a partially cut-away perspective view of part of a jacket produced from the complex of FIGS. 1 and 2.

It should be pointed out that, in the complex shown in FIGS. 3 to 5, the layers 2, 3 and 4 are generally not joined together but merely juxtaposed. However, it is quite possible for some of these layers, for example in the case of specific requirements, to be joined together by bonding.

The thickness of each rib is about 1 mm and the spacing of the ribs is about 10 mm.

FIG. 5 shows a jacket 6 which is produced from the textile complex as defined and in which the ribs 5 are oriented vertically.

Figure 2:
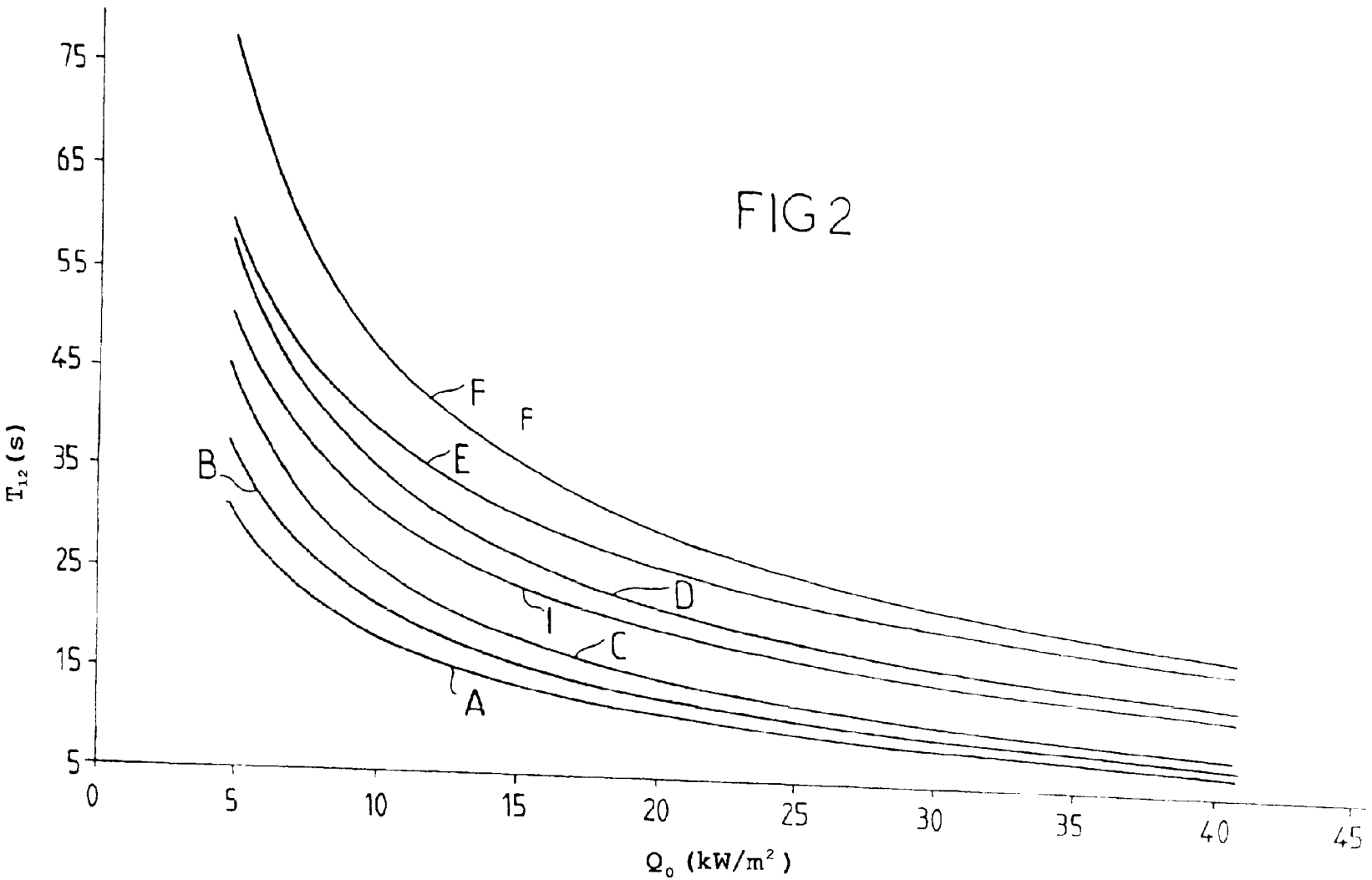
FIG. 2 shows a series of curves illustrating the change in the alerting time $T_{.12}$ as a function of the incident heat flux $Q_0$.

The curves in FIGS. 1 and 2 illustrate the behavior of a complex I according to the invention.

This complex has the advantage, compared with certain existing complexes, of being lighter and more pliant, the ribs 5 advantageously replacing a felt intended to trap air. These ribs are lighter and more pliant than a felt or than a three-dimensional knit.

The water absorbtivity of these ribs is very small compared with such a felt or three-dimensional knit, thereby greatly limiting the phenomenon of pumping and storing the sweat in the garment.

Thus, the ability of the insulating complex of the invention to pump and store water amounts virtually to that of the lining used as support for the ribs, which, in its embodiment as described above, represents 2.5 times its dry weight. In comparison, that of the complex F using a felt, which acts like a sponge, is 10 times its dry weight.

Kept at a certain distance from the membrane by the ribs, the lining serving as a support for the complex of the invention is converted into a surface for exchange of the sweat (which it absorbs) with the air circulating in the channels formed by these said ribs, increasing the rate of evaporation and allowing the body to thermoregulate itself far more rapidly. The onset of thermal stress is thus delayed or even eliminated, especially under the usual working conditions (0–1 kW/m$^2$).

This low water absorbtivity of the complex according to the invention also has the advantage of limiting the risk of the wearer being burnt by vaporization of the water trapped in the jacket in the event of exposure to a sudden heat flux.

The invention also avoids the aspect of the garment becoming heavier in use, a factor that aggravates thermal stress. Indeed, recent physiological studies have demonstrated that the weight of textile firefighting jackets for firemen has a direct influence on the thermal stress caused.

From the protection standpoint, the volume of air retained in the channels ensures satisfactory thermal insulation while limiting rapid transmission of heat under critical conditions (a flux of about 40 kW/m$^2$). The structure of this complex also ensures good sensitivity to heat under normal operating conditions, and therefore a short alerting time $T_{.12}$, because of its low surface density as shown in FIG. 2. This alerting time under normal conditions approaches that of the leather+lining complexes recognized as being safer than conventional textile complexes which are too insulating (curves E and F).

It is apparent from FIG. 1 that, in terms of thermal conduction and of non-confinement of the heat, the complex according to the invention provides good comfort at low energy, 0 to 1 kW/m$^2$ (normal working conditions) comparable to that of the leather+lining complexes recognized as posing few problems in terms of thermal stress, which means a relatively high TF% (good heat transmission). On the other hand, for a high incident heat flux (about 40 kW/m$^2$), it has a low heat transmission factor TF% (good insulation), comparable to that of the much heavier complexes which are less comfortable and retain water much more.

The comfort of this complex in terms of reducing thermal stress is also expressed by a particularly low Ret (evaporative resistance) compared with the existing products on the market.

The more the complex of the jacket allows effective evaporation of the sweat, which means that it will have a low evaporative resistance, the better the body will be able to thermoregulate and itself avoid accidents.

The table below gives the Ret values of the various complexes in FIG. 1 (measured according to the EN 31092 standard):

C: 85.0 m$^2$.Pa/W

D: 26.7 m$^2$.Pa/W

E: 28.5 m$^2$.Pa/W

F: 31.0 m$^2$.Pa/W

I: 25.6 m$^2$.Pa/W.

This classification changes in parallel with the $T_{.12}$ which illustrates the thermal sensitivity of the complex. This therefore gives two advantages in terms of comfort by combining low thermal insulation (low heat storage) under normal conditions and good evaporation, hence a major advance in terms of reducing the risk of thermal stress.

As goes without saying, the invention is not limited to the single embodiment of this textile complex nor to its single application to the production of a jacket; on the contrary, it encompasses all variants thereof. Thus, in particular, the lining could be made of a material other than a fabric, it could be combined with a membrane or with a film, the ribs could be discontinuous and/or could be made of another material, such as silicone, or could be fastened by means other than by bonding or stitching to the lining, or the complex could consist of two layers not bonded together, such as a pair of trousers and a pair of overtrousers, on the inner face of which there would be ribs, without thereby departing from the scope of the invention.

What is claimed is:

1. A textile complex for producing thermal protective garments comprising:

at least one fabric, or a textile web, made of a non-flammable material forming an outer face of the complex; and a comfort and antisoil lining forming an inner face of the complex:

wherein on an inner face of the fabric and/or on an outer face of the lining there are ribs made of a textile material having approximately a same orientation with respect to each other, the ribs being fastened by bonding to the fabric and/or to the lining during manufacture of the fabric and/or lining, in order to form an integral part thereof, and defining air-filled channels between the fabric and the lining.

2. The textile complex as claimed in claim 1, wherein the ribs are continuous.

3. The textile complex as claimed in claim 1, wherein the ribs are discontinuous.

4. The textile complex as claimed in claim 1, wherein the lining has, on a face turned toward the outside of the complex, ribs having approximately a same orientation with respect to each other and defining, with a facing wall of the complex, air-filled channels.

5. The textile complex as claimed in claim 1, wherein the ribs are made of a material which compresses little with an increase in heat.

6. The textile complex as claimed in claim 5, wherein each rib is made of heat-stable fibers.

7. The textile complex as claimed in claim 1, wherein each rib is formed by a combination of yarns assembled together.

8. The textile complex as claimed in claim 1, wherein each rib is fastened to the lining by bonding using the threads of this lining, during the manufacture of the latter.

9. The textile complex as claimed in claim 1, wherein the thickness of each rib is greater than 0.3 mm.

10. The textile complex as claimed in claim 1, wherein the spacing of the ribs is greater than 2 mm.

11. A garment produced from a textile complex as claimed in claim 1, wherein the ribs and the channels that they define have a longitudinal overall orientation with respect to the garment.

12. The textile complex as claimed in 9, wherein the thickness of each rib is between 1 and 10 mm.

13. The textile complex as claimed in claim 10, wherein the spacing of the ribs is between 2 and 15 mm.

14. The textile complex as claimed in claim 6, wherein the heat stable fibers are para-aramid fibers.

15. The textile complex as claimed in claim 7, wherein the combination of yarns is two Nm 9/2 folded yarns twisted together.

16. The garment of claim 11, wherein the longitudinal overall orientation is a vertical orientation.

17. The garment of claim 16, wherein the garment is a jacket.

* * * * *